US007770367B2

(12) United States Patent
Haschke et al.

(10) Patent No.: US 7,770,367 B2
(45) Date of Patent: Aug. 10, 2010

(54) DUAL MODE BAGGER

(75) Inventors: Eggo Haschke, Deerfield, IL (US); Mark Prokurat, Plymouth, MI (US)

(73) Assignee: Poly-Clip System Corp., Mundelein, IL (US)

( * ) Notice: Subject to any disclaimer, the term of this patent is extended or adjusted under 35 U.S.C. 154(b) by 67 days.

(21) Appl. No.: 12/192,223

(22) Filed: Aug. 15, 2008

(65) Prior Publication Data

US 2009/0044488 A1 Feb. 19, 2009

Related U.S. Application Data

(60) Provisional application No. 60/956,294, filed on Aug. 16, 2007.

(51) Int. Cl.
*B65B 31/04* (2006.01)

(52) U.S. Cl. ..... 53/512; 53/510; 53/79; 53/434; 53/111 R

(58) Field of Classification Search ..... 53/427–428, 53/432, 434, 469, 79, 89–91, 97, 111 R, 510, 53/512

See application file for complete search history.

(56) References Cited

U.S. PATENT DOCUMENTS

| | | | | | |
|---|---|---|---|---|---|
| 3,313,509 | A * | 4/1967 | Lockert | 248/244 |
| 3,550,891 | A | 12/1970 | Scott | |
| 3,795,085 | A | 3/1974 | Andre et al. | |
| 3,958,391 | A * | 5/1976 | Kujubu | 53/434 |
| 4,578,928 | A * | 4/1986 | Andre et al. | 53/512 |
| 4,580,393 | A * | 4/1986 | Furukawa | 53/512 |
| 4,586,320 | A * | 5/1986 | Takai et al. | 53/512 |
| 4,843,796 | A * | 7/1989 | Furukawa | 53/434 |
| 5,009,060 | A * | 4/1991 | Furukawa | 53/512 |
| 5,305,898 | A * | 4/1994 | Merl | 211/87.01 |
| 5,482,168 | A | 1/1996 | Welch et al. | |
| 6,142,317 | A | 11/2000 | Merl | |
| 7,246,711 | B1 * | 7/2007 | Metcalf | 211/175 |
| 2005/0252869 | A1 * | 11/2005 | Graham | 211/36 |

OTHER PUBLICATIONS

International Search Report and Written Opinion of the International Searching Authority, received in the co-pending PCT application for this matter.
PCT /IPEA/416, Oct. 14, 2009, Poly-clip System Corp.

* cited by examiner

*Primary Examiner*—Christopher Harmon
(74) *Attorney, Agent, or Firm*—Trexler, Bushnell, Giangiorgi, Blackstone & Marr, Ltd.

(57) ABSTRACT

An apparatus for sealing a bag of encased material is described. A plurality of nozzles radiate from a central vacuum system, each nozzle associated with a clamping means. A framework rotates about the central vacuum system. A holding tray and an elevating device are removably attachable to the framework. The holding tray is attachable below a one of the plurality of nozzles and comprises an upright section and a projecting section. The upright section is supported by the framework at an acute angle from vertical, a top end of the upright section being adjacent to the framework and a bottom end of the upright section being remote from the framework. The projecting section is removably attachable to the bottom end of the upright section and projects approximately normal to the upright section. The elevating device is removably attachable to the framework below a one of the plurality of nozzles.

11 Claims, 6 Drawing Sheets

DUAL MODE BAGGER

PRIORITY

This application claims the benefit of U.S. Provisional Patent Application No. 60/956,294, filed Aug. 16, 2007, the disclosure of which is incorporated herein.

BACKGROUND OF THE INVENTION

This invention is generally directed to a system for encasing materials, such as poultry or other materials, in plastic bags. The invention is directed at packaging poultry such as whole dressed chickens, ducks, geese, and turkeys, but can be used as well for poultry parts, such as turkey breasts, for whole-muscle meats, such as hams, for other food items such as game, cheeses, and sausages, and for non-food items as well.

The food industry sometimes sells items as described above in plastic bags. It is preferable in some instances to evacuate the bag before sealing it, for both marketability reasons and health reasons. In general, whole dressed birds are placed in a plastic bag, the bag is drawn closed by gathering the mouth of the bag into a neck around a nozzle, the neck of the bag is held around the nozzle by the jaws of a clipping apparatus, a vacuum is drawn on the nozzle to remove excess air from the bag, causing the bag to collapse around the bird, and a clip is applied to the neck of the bag to seal the bag. A representative packaged assembly 20 of a whole dressed bird 22 encased in a plastic bag 24 and sealed therein by a clip 26, as is known in the prior art, is shown in FIG. 1.

The process as described above has been automated, for example by the apparatus described in U.S. Pat. No. 3,795,085, Device for the Evacuation, Clipping, and Trimming of Bag-Like Packages, the disclosure of which is incorporated herein by reference. An apparatus of this type generally comprises a rotating circular table, a plurality of radially-oriented evacuation nozzles, and a clamping means at each nozzle. A bagged product, such as a dressed goose 22 in a plastic bag 24, is applied to each of the vacuum nozzles at a first position. As each vacuum nozzle travels circularly, the clamping means closes to seal the 24 bag to the nozzle, the vacuum nozzle evacuates the bag 24, a clip 26 is applied, the excess bag or "tail" is removed, the clamping means opens, and the now packaged goose 20 is removed from the table.

The bagged package 20, as this process has been used in the prior art, rests on the rotating circular table, which is below the level of the vacuum nozzle. Accordingly, the neck of the bag 24 always is located above the packaged item 20 and the clip 26 is applied above the packaged item 20, as shown in FIG. 1. Some consumers find this appearance objectionable for some types of food items. Those food items would present a more pleasing appearance if the clip 26 were not visible from the front of the packaged assembly 20, as shown in, for example, FIGS. 2A and 2B. For other food items, the appearance as shown in FIG. 1 is satisfactory.

Accordingly, a need exists for an apparatus and method to package whole dressed birds or parts in plastic bags, without the clip showing. A further need exists for an apparatus to package whole dressed birds or parts in plastic bags, the apparatus being adaptable between packaging with the clip showing or without the clip showing. The present invention meets this need.

BRIEF SUMMARY OF THE INVENTION

The present invention comprises an apparatus for bagging material in a first mode, whereby the clip used to seal the bag is on top of the packaged assembly, and in a second mode, whereby the clip used to seal the bag is on the side of the packaged assembly. In a first embodiment, the present invention comprises a plurality of nozzles radiating from a central vacuum system, each nozzle associated with a clamping means, a framework rotatable about the central vacuum system, and a holding tray and an elevating device. The holding tray is removably attachable to the framework below a one of the plurality of nozzles, the holding tray comprising an upright section and a projecting section, the upright section supported by the framework at an acute angle from vertical, a top end of the upright section being adjacent to the framework and a bottom end of the upright section being remote from the framework, the projecting section removably attachable to the bottom end of the upright section and projecting approximately normal to the upright section. The elevating device is removably attachable to the framework below a one of the plurality of nozzles, the elevating device comprising an upright section, a lower strut, and an upper strut, the upright section supported by the framework at an acute angle from vertical, a top end of the upright section being adjacent to the framework and a bottom end of the upright section being remote from the framework, the lower strut having a first end and a second end, the first end of the lower strut being attached to a first end of the upper strut and the second end of the lower strut being releasably attached to the bottom end of the upright section, a second end of the upper strut being releasably attachable to the top end of the upright section. In another embodiment, the apparatus has a single upright section supported by the framework, to which is attached either a projecting section or a pair of struts.

BRIEF DESCRIPTION OF THE SEVERAL VIEWS OF THE DRAWINGS

The organization and manner of the structure and operation of the invention, together with further objects and advantages thereof, may best be understood by reference to the following description, taken in connection with the accompanying non-scale drawings, wherein like reference numerals identify like elements in which.

DETAILED DESCRIPTION OF THE PREFERRED EMBODIMENTS OF THE INVENTION

Figure 1:
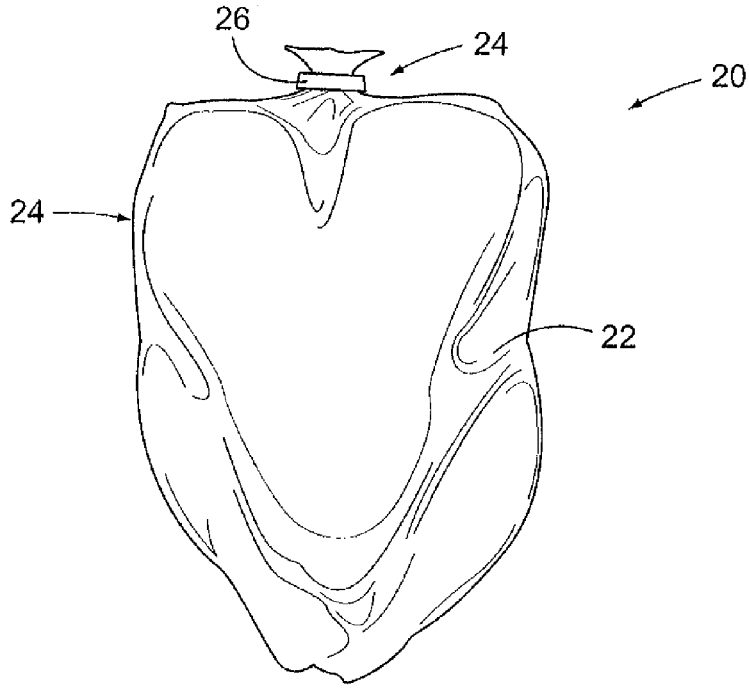
FIG. 1 is a front elevation view of packaged assembly of a whole dressed bird, a plastic bag, and a clip, as is known in the prior art.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 4:
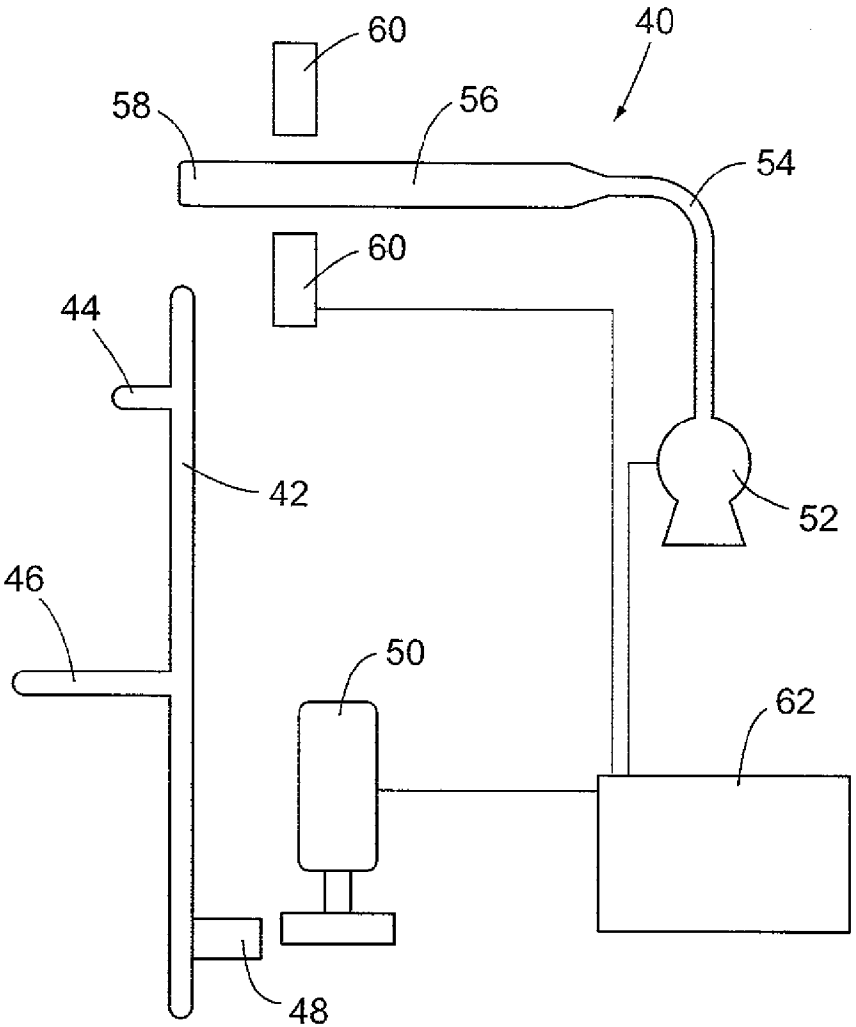
FIG. 4 is a side elevation view of the apparatus of FIG. 3.
Figure 3:
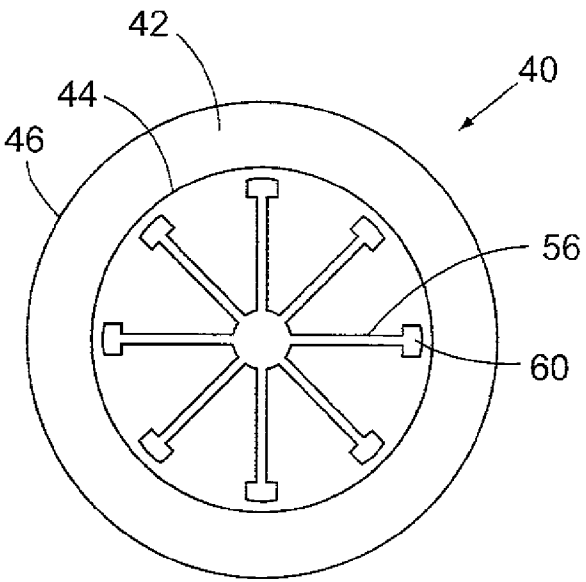
FIG. 3 is a top plan view of the apparatus of the preferred embodiment of the present invention.

The packaging apparatus 40 of the preferred embodiment of the present invention, as shown in FIGS. 3 and 4, has a rotatable framework 42 having an upper connection lug 44 and a lower connection lug 46. Preferably, framework 42 is a circular assembly with lugs 44, 46 projecting radially from an outer circumference of framework 42. Framework 42 is connected, preferably by a gear assembly 48, to a motor 50. In other embodiments, motor 50 drives framework 42 in a rotating motion by belts, shafts, cranks, cams, or other means.

A central vacuum pump 52 is connected by suitable piping 54 to a plurality of vacuum nozzles 56. In the illustrated embodiment, there are eight vacuum nozzles 56, but in other embodiments, other numbers of vacuum nozzles can be used. The tip 58 of each vacuum nozzle 56 extends through a clamping means 60. Each clamping means 60 in the preferred embodiment comprises a conventional clipping apparatus, including gathering jaws, a clip rail, a punch, and a die, and is actuated by one or more air-actuated cylinders connected to a compressed air supply to apply a conventional clip. In other embodiments, other clamping means 60 are used, such as wire or band sealers, tapers, and tying devices. In yet other embodiments, manually-operated devices that apply conventional clips, wires, bands, sealing tape, twist ties, cables, or other sealing means are used. In yet other embodiments, clamping means 60 comprises an operator who manually applies sealing means.

In the preferred embodiment, a central controller 62 is coupled to each of motor 50, pump 52, and each clamping means 60. Controller 62 is preferably an electronic control, such as a standard Siemens central processing unit, with a "power 5 6EP1333-1SL11" power supply, a "Simatic S7-300 314-1AEO4-0AB0" PLC, a 32-output "SM322 321-1BL00-0AA0" card, a 32-input "SM 321 321-ABL00-0AA0" card, and a 16-input "SM 321 321-1BH0S-0AA0" card. In other embodiments, other PLC-based electronic controls are used. In other embodiments, controller 62 is an analog controller. In yet other embodiments, apparatus 40 is controlled manually.

Figure 5C:
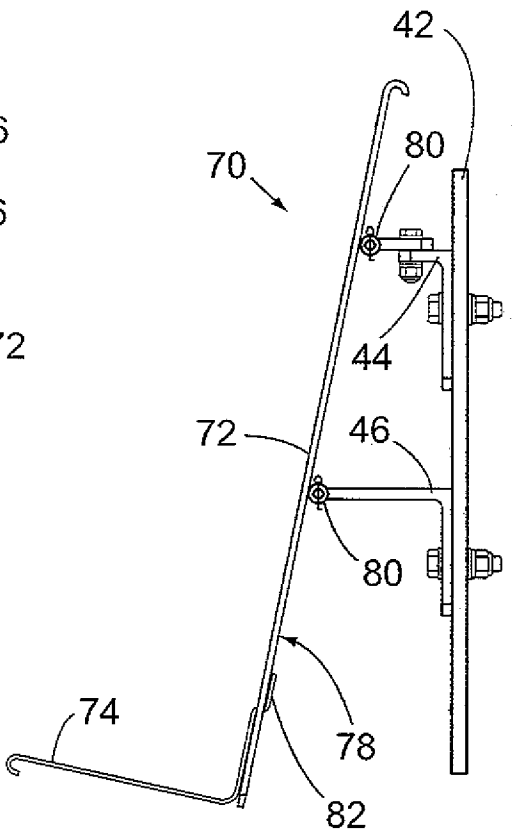
FIG. 5C is a side elevation view of the holding tray of FIG. 5A.
Figure 5B:
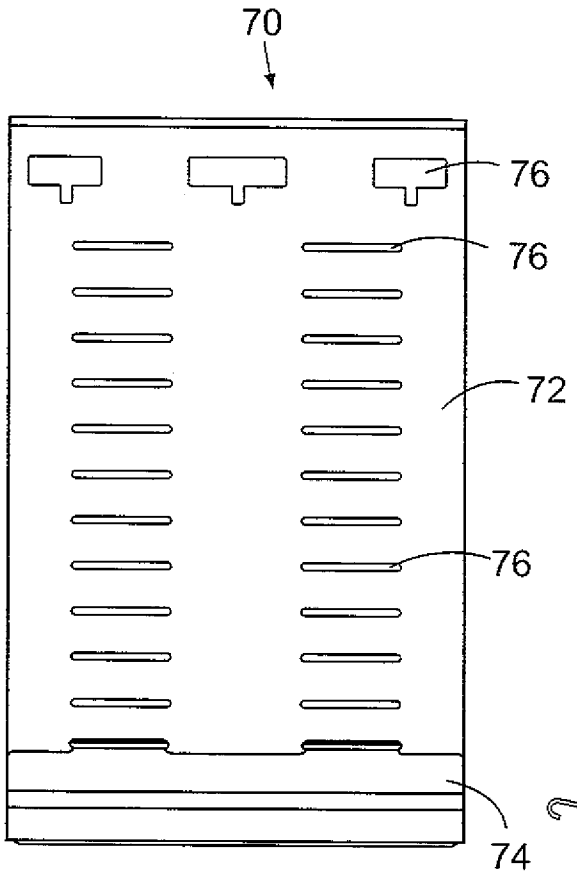
FIG. 5B is a front elevation view of the holding tray of FIG. 5A.
Figure 5A:
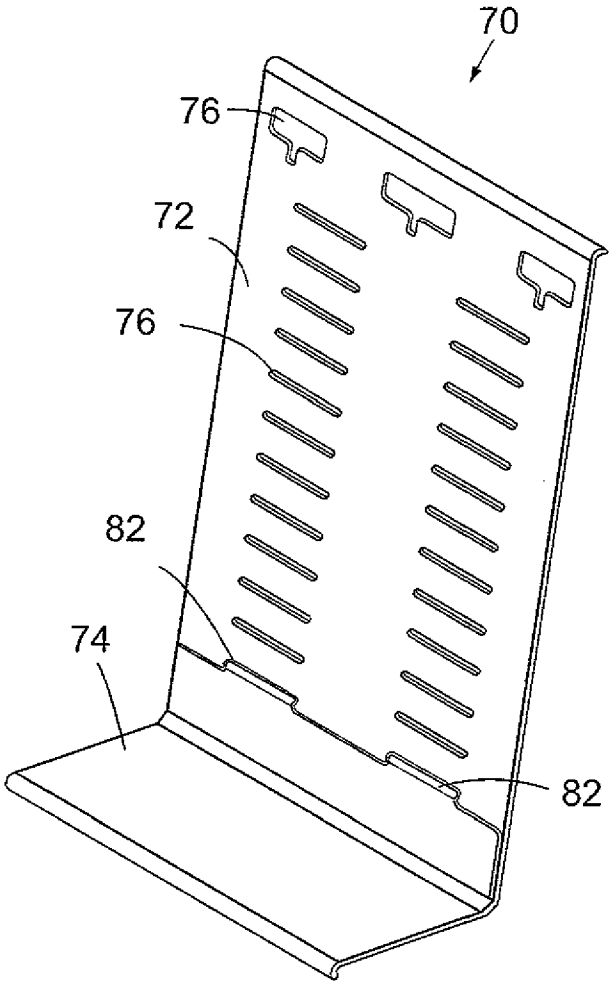
FIG. 5A is a perspective view of the holding tray for use with the apparatus of FIG. 3.

In one embodiment, a holding tray 70 has an upright section 72 and a projecting section 74, as shown in FIGS. 5A, 5B, and 5C. Each holding tray 70 is preferably removably mountable to framework 42 adjacent each nozzle 56. Upright section 72 is a flat, rectangular sheet having a plurality of slits 76 forming apertures therethrough. The backside 78 of tray 70 has two connection means 80 for attaching to lugs 44, 46. Connection means 80 are preferably eyes projecting from backside 78 through which cotter pins are insertable to mate with matching eyes on lugs 44, 46. In other embodiments, connection means 80 comprise screws, bolts, clamps, bayonet assemblies, friction fit assemblies, or other devices.

In the preferred embodiment, upper connection lug 44 is shorter than lower connection lug 44. Accordingly, upright section 72 is angled with respect to vertical, with the top of upright section 72 closer to framework 42 and the bottom of upright section 72 farther from framework 42.

Projecting section 74 is an L-shaped device, preferably having a pair of tongues 82 insertable into corresponding slits 76 on upright section 72. Accordingly, the distance between projecting section 74 and nozzle 56 can be adjusted for items of different sizes, such as large turkeys and smaller geese, by inserting tongues 82 into different slits 76. In other embodiments, projecting section 74 is secured to upright section 72. In other embodiments, projecting section 74 is removably attachable to upright section 72 by bolts, pins, or other connection means. Projecting section 74 is mounted or attached preferably approximately normal to the plane of upright section 72, as illustrated, in order to keep a bag of encased material held thereon.

In the preferred embodiment, holding tray 70 comprises a discrete unit and packaging apparatus 40 will normally have one holding tray 70 for each nozzle 56. Each holding tray 70 can be mounted and removed from framework 42. In another embodiment, upright section 70 is integral to framework 42 or is securely attached to framework 42. In this embodiment, packaging apparatus will have one upright section 70 mounted at each nozzle 56 and one removable projecting section 74 for each nozzle 56. Each projecting section 74 can be mounted or removed from packaging apparatus 40 as described above.

Figure 6:
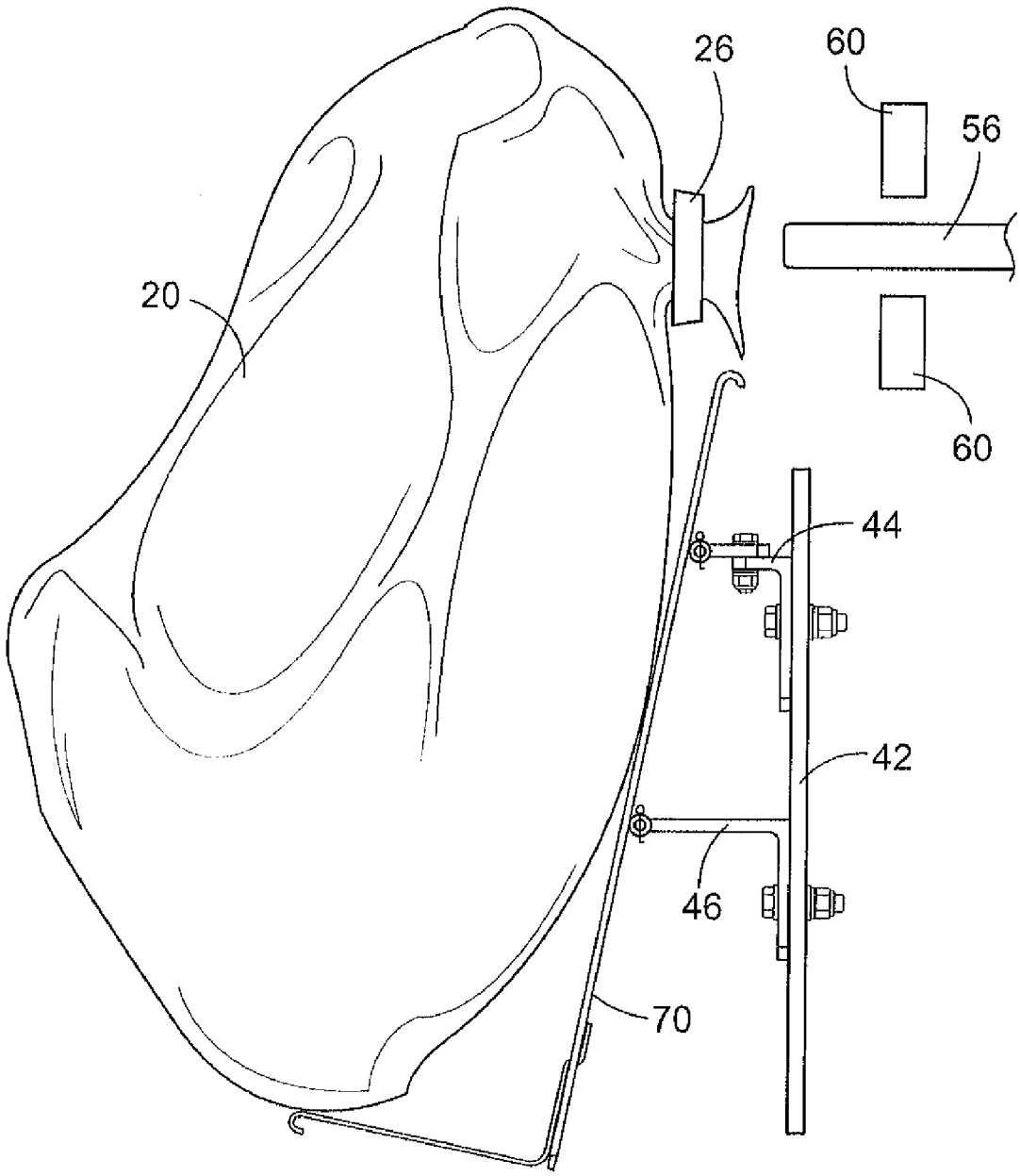
FIG. 6 is a side elevation view of a packaged assembly of a whole dressed bird encased in a bag by a clip, on the holding tray of FIG. 5A.

To use apparatus 40 in a first mode to create a sealed packaged assembly 120, an item to be bagged, such as a dressed goose 122, is placed in a plastic bag 124 and placed upon holding tray 70. The neck of bag 124 is placed over nozzle 56 at a first station and clamping means 60 closes to hold bag 124 on nozzle 56. As framework 42 rotates, vacuum pump 52 pulls the excess air out of bag 124, causing bag 124 to collapse about goose 22. Clamping means 60 then applies a clip 126 to bag 124, sealing goose 122 within bag 124 to form packaged assembly 120, as shown in FIG. 6. Because holding tray 70 holds the loose bag 124 and goose 122 above the level of nozzle 56, as shown in FIG. 6, clip 126 is applied partway down a side of bag 124. Thus, packaged assembly 120 is formed as shown in front view in FIG. 2A and in side view in FIG. 2B. When packaged assembly is placed in a grocer's case or other display for sale, the consumer's view will be the one shown in FIG. 2A, rather than the one shown in FIG. 1.

Figure 7A:
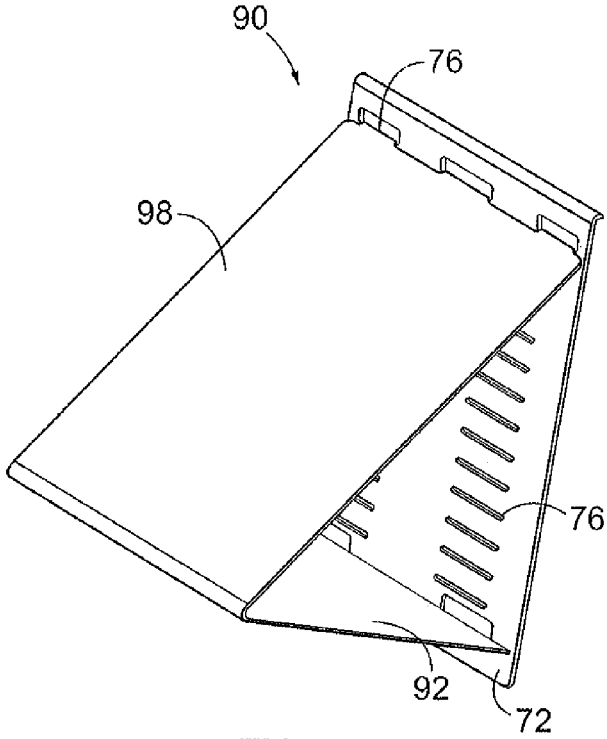
FIG. 7A is a perspective view of the elevating device for use with the apparatus of FIG. 3.
Figure 7B:
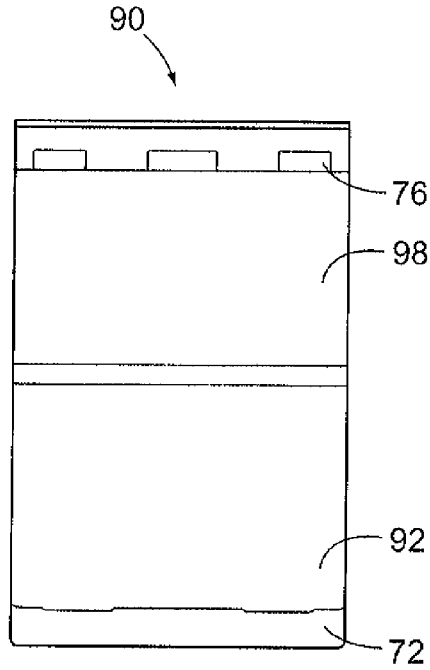
FIG. 7B is a front elevation view of the elevating device of FIG. 7A.
Figure 7C:
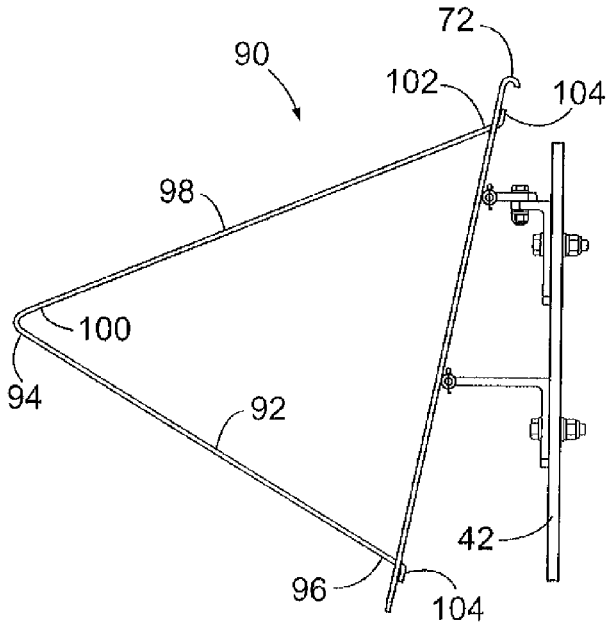
FIG. 7C is a side elevation view of the elevating device of FIG. 7A.

An elevating device 90 is used to adapt apparatus 40 to a second mode. In one embodiment, as shown in FIGS. 7A, 7B, and 7C, elevating device 90 has a bottom strut 92 having a first end 94 and a second end 96, a top strut 98 having a first end 100 and a second end 102, and upright section 72. Upright section 72 is preferably identical to upright section 72 as described above. Bottom strut 92 projects at its first end 94 from the first end 100 of top strut 98 at an acute angle, preferably about sixty degrees. Each second end 96, 102 has projecting tongues 104. Preferably, each end 96, 102 has two tongues 104, but a single tongue or a greater multiplicity of tongues can be used. In other embodiments, other means are used to attach elevating device 90 to packaging apparatus 40.

Figure 2A:
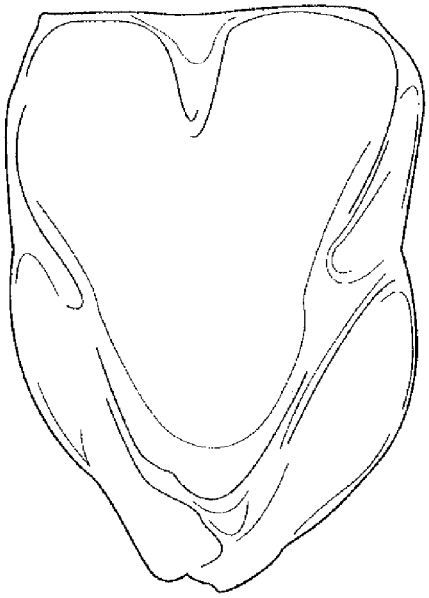
FIG. 2A is a front elevation view of a packaged assembly of a whole dressed bird and a plastic bag as assembled by the apparatus of the preferred embodiment of the present invention.
Figure 2B:
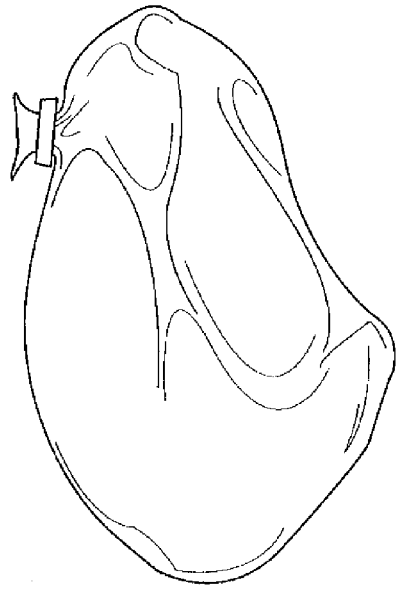
FIG. 2B is a side elevation view of the packaged assembly of FIG. 2A, showing a clip on the backside of the assembly.
Figure 8:
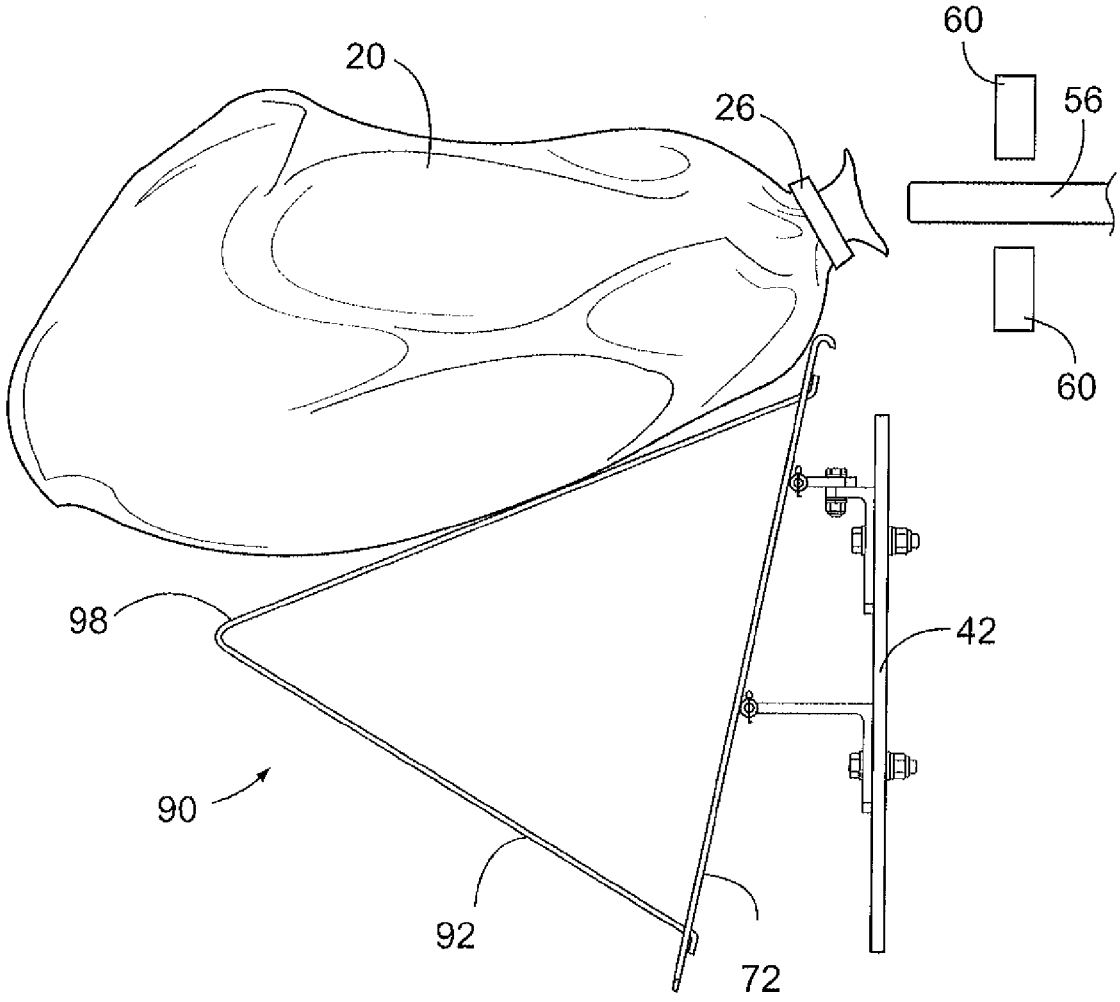
FIG. 8 is a side elevation view of a packaged assembly of a whole dressed bird encased in a bag by a clip, on the elevating device of FIG. 7A.

To use packaging apparatus 40 in a second mode to create a sealed packaged assembly 120, projecting section 74 is removed from upright section 72. Tongues 104 are inserted into corresponding slits 76 in upright section 72. An item to be bagged, such as a dressed chicken 22, is placed in a plastic bag 24 and upon top strut 98. The neck of bag 24 is placed over nozzle 56 at a first station and clamping means 60 closes to hold bag 24 on nozzle 56. As framework 42 rotates, vacuum pump 52 pulls the excess air out of bag 24, causing bag 24 to collapse about chicken 22. Clamping means 60 then applies a clip 26 to bag 24, sealing chicken 22 within bag 24 to form packaged assembly 20. Because top strut 98 holds the loose bag 24 and chicken 22 at an angle pointed directly at nozzle 56, as shown in FIG. 8, clip 26 is applied at the top of bag 24. Thus, packaged assembly 20 is formed as shown in FIG. 1. When packaged assembly 20 is placed in a grocer's case or other display for sale, the consumer's view will be the one shown in FIG. 1.

While preferred embodiments of the present invention are shown and described, it is envisioned that those skilled in the art may devise various modifications of the present invention without departing from the spirit and scope of the appended claims.

We claim:

1. An apparatus for sealing a bag of encased material, comprising:

a plurality of nozzles radiating from a central vacuum system, each said nozzle associated with a clamping means;

a framework rotatable about said central vacuum system; and interchangeable structure for operating said apparatus in a first mode and in a second mode, said interchangeable structure comprising a holding tray and an elevating device, said holding tray removably attachable said framework below a one of said plurality of nozzles, said holding tray comprising an upright section and a projecting section, said upright section supported by said framework at an acute angle from vertical, a top end of said upright section being adjacent to said framework and a bottom end of said upright section being remote from said framework, said projecting section removably attachable to said upright section in a plurality of positions to adjust a distance between said projecting section and said one of said plurality of nozzles, said projecting section configured to support a bottom of the bag, said elevating device removably attachable to said framework below a one of said plurality of nozzles, said elevating device comprising an upright section, a lower strut, and an upper strut, said upright section supported by said framework at an acute angle from vertical, a top end of said upright section being adjacent to said framework and a bottom end of said upright section being remote from said framework, said lower strut having a first end and a second end, said first end of said lower strut being attached to a first end of said upper strut and said second end of said lower strut being releasably attached to said bottom end of said upright section, a second end of said upper strut being releasably attachable to said top end of said upright section.

2. The apparatus of claim 1, wherein said upright section of said holding tray and said upright section of said elevating device releasably attach to lugs projecting outward from said framework.

3. The apparatus of claim 1, wherein said projecting section attaches to said upright section of said holding tray by a tongue inserted into a slit.

4. The apparatus of claim 3, wherein said upright section comprises a plurality of slits and said projecting section comprises a tongue.

5. The apparatus of claim 1, wherein said top strut and said bottom strut attach to said upright section of said holding tray by tongues inserted into slits.

6. The apparatus of claim 1, wherein said top strut and said bottom strut comprise an integral unit.

7. An apparatus for sealing a bag of encased material, comprising:

a plurality of nozzles radiating from a central vacuum system, each said nozzle associated with a clamping means;

a framework rotatable about said central vacuum system;

means for holding the bag of encased material at a first angle relative to said plurality of nozzles; and means for holding the bag of encased material at a second angle relative to said plurality of nozzles.

8. An apparatus for sealing a bag of encased material, comprising:

a plurality of nozzles radiating from a central vacuum system, each said nozzle associated with a clamping means;

a framework rotatable about said central vacuum system;

an upright section mounted on said framework at an acute angle from vertical, a top end of said upright section being adjacent to said framework and a bottom end of said upright section being remote from said framework;

interchangeable structure for operating said apparatus in a first mode and in a second mode, said interchangeable structure comprising a projecting section for operating the apparatus in a first mode and a lower strut and an upper strut for operating the apparatus in a second mode, said projecting section removably attachable to said bottom end of said upright section and projecting approximately normal to said upright section; and said lower strut having a first end and a second end, said first end of said lower strut being attached to a first end of said upper strut and said second end of said lower strut being releasably attached to said bottom end of said upright section, a second end of said upper strut being releasably attachable to said top end of said upright section.

9. The apparatus of claim 8, wherein said projecting section attaches to said upright section by a tongue inserted into a slit.

10. The apparatus of claim 9, wherein said upright section comprises a plurality of slits and said projecting section comprises a tongue.

11. The apparatus of claim 8, wherein said upper strut and said lower strut comprise an integral unit.

* * * * *